US007628830B2

(12) United States Patent
Ohtsu et al.

(10) Patent No.: US 7,628,830 B2
(45) Date of Patent: Dec. 8, 2009

(54) ELECTRIC VACUUM CLEANER

(75) Inventors: Yasuhiro Ohtsu, Kanagawa (JP); Masatoshi Tanaka, Kanagawa (JP); Yuji Otsuka, Kanagawa (JP); Yukio Machida, Kanagawa (JP); Mitsuru Watanabe, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 215 days.

(21) Appl. No.: 11/729,654

(22) Filed: Mar. 29, 2007

(65) Prior Publication Data

US 2007/0226952 A1 Oct. 4, 2007

(30) Foreign Application Priority Data

Mar. 31, 2006 (JP) ..... 2006-099862

(51) Int. Cl.
*B01D 46/00* (2006.01)

(52) U.S. Cl. ..... 55/300; 55/304; 55/417; 55/420; 55/428; 55/482; 55/DIG. 3; 15/347; 15/352

(58) Field of Classification Search ..... 15/342, 15/352; 55/DIG. 3, 300, 304, 315, 417, 420, 55/459.1, 464, 482; 95/282
See application file for complete search history.

(56) References Cited

U.S. PATENT DOCUMENTS 3,591,888 A * 7/1971 Takeda et al. ..... 15/323
3,856,488 A * 12/1974 Kato et al. ..... 55/300
5,223,005 A * 6/1993 Avondoglio ..... 95/280
5,681,363 A * 10/1997 Tucker et al. ..... 55/300
6,428,589 B1 * 8/2002 Bair et al. ..... 55/318

(Continued)

FOREIGN PATENT DOCUMENTS

EP 1 629 760 A2 3/2006

(Continued)

OTHER PUBLICATIONS

Related U.S. Appl. No. 11/729,655, filed on Mar. 29, 2007; Inventors: Yasuhiro Ohtsu et al, Title: Vacuum Cleaner.

(Continued)

*Primary Examiner*—Duane Smith
*Assistant Examiner*—Sonji Turner
(74) *Attorney, Agent, or Firm*—Frishauf, Holtz, Goodman & Chick, P.C.

(57) ABSTRACT

An electric vacuum cleaner includes a first dust separation device configured to separate sucked dust, a first dust collection section for collecting the separated dust, a second dust separation device configured to separate the dust, a dust removing device configured to remove the dust adhering to the second dust separation device, a second dust collection section for accumulating the removed dust, a partition wall for zoning the first dust collection section and the second dust collection section and an introduction opening for introducing the removed dust into the second dust collection section; the partition wall includes a communication opening for communicating the first dust collection section to the second dust collection section and an opening and closing member for closing either of the introduction opening or the communication opening and switching the closing to the other by rotating, and the opening and closing member closes the introduction opening with a negative pressure by an electric fan and closes the communication opening by its own weight when the electric fan is not driven.

6 Claims, 9 Drawing Sheets

U.S. PATENT DOCUMENTS

| | | | | |
|---|---|---|---|---|
| 6,598,263 | B2 * | 7/2003 | Boles et al. | 15/352 |
| 7,047,593 | B2 * | 5/2006 | Kitamura et al. | 15/353 |
| 7,346,957 | B2 * | 3/2008 | Nakamoto et al. | 15/352 |
| 7,351,269 | B2 * | 4/2008 | Yau | 55/297 |
| 7,412,749 | B2 * | 8/2008 | Thomas et al. | 15/344 |
| 2002/0124729 | A1 * | 9/2002 | Dudley | 95/282 |
| 2006/0016043 | A1 | 1/2006 | Matsuhashi et al. | |
| 2006/0042203 | A1 | 3/2006 | Kuroki et al. | |

FOREIGN PATENT DOCUMENTS

| | | | |
|---|---|---|---|
| JP | 54003375 | A * | 1/1979 |
| JP | 2006-006383 | A | 1/2006 |

OTHER PUBLICATIONS

Extended European Search report issued in Application Serial No. 07 00 6452 dated Dec. 22, 2008.

* cited by examiner

ELECTRIC VACUUM CLEANER

TECHNICAL FIELD

The present invention relates to an electric vacuum cleaner including first and second dust separation devices for separating vacuumed dust.

BACKGROUND

There is conventionally known an electric vacuum cleaner including a first dust separation device for separating dust and a second dust separation device for separating dust which has passed through the first dust separation device (refer to JP2006-6383A).

The electric vacuum cleaner includes the first dust separation device for separating dust vacuumed by a negative pressure of an electric fan, a first dust collection section for collecting the dust separated by the first dust separation device, the second dust separation device for separating the dust which has passed through the first dust separation device, a dust removing device for removing the dust adhering to the second dust separation device and a second dust collection section provided in the lower portion of the second dust separation device, for accumulating the dust removed by the dust removing device. An introduction opening provided in the upper portion of the second dust collection section is provided with an openable and closable opening and closing member. The opening operation and closing operation of the opening and closing member are conducted in conjunction with a pulling-out operation and a retracting operation of a power source cord.

More particularly, the opening and closing member closes the introduction opening of the second dust collection section, when pulling-out the power source code and the opening and closing member opens the introduction opening, when retracting the power source code.

In addition, when the power source cord is retracted, the dust removing device for removing the dust adhering to the second dust separation device is operated, disposing the dust removed by the second dust separation device into the second dust collection section from the introduction opening.

In operation of the electric fan, i.e., when the power source cord is pulled out, the introduction opening of the second dust collection section is closed by the opening and closing member. Accordingly, the dust accumulated in the second dust collection section is prevented from rising to adhere again to the second dust collection section.

However, the above electric vacuum cleaner has a problem in that its structure is complex, because the opening and closing operation of the opening and closing member requires an interlocking mechanism which operates in conjunction with the pulling-out operation and retracting operation of the power source cord.

SUMMARY

It is, therefore, an object of the present invention to provide an electric vacuum cleaner capable of opening and closing an introduction opening of a second dust collection section by means of a simple structure.

One aspect of the invention relates to an electric vacuum cleaner including a first dust separation device configured to separate dust vacuumed by a negative pressure of an electric fan, a first dust collection section for collecting the dust separated by the first dust separation device, a second dust separation device configured to separate the dust which has passed through the first dust separation device, a dust removing device configured to remove the dust adhering to the second dust separation device, a second dust collection section positioned in an upstream side of the second dust separation device and provided in a lower portion of the second dust separation device, for accumulating the dust removed by the dust removing device, a partition wall for zoning the first dust collection section and the second dust collection section, and an introduction opening for introducing the dust removed by the dust removing device into the second dust collection section, wherein the partition wall is provided with a communication opening for communicating the first dust collection section to the second dust collection section, the partition wall is provided with an opening and closing member for closing either of the introduction opening or the communication opening and switching the closing to the other by rotating, and the opening and closing member closes the introduction opening with the negative pressure by driving of the electric fan and closes the communication opening by its own weight when the electric fan is not driven.

Preferably, the communication opening is formed in an upper portion of the second dust collection section.

Advantageously, a bottom portion of the first dust collection section and a bottom portion of the second dust collection section are simultaneously opened, so as to simultaneously discharge the dust accumulated in the first dust collection section and the second dust collection section.

In a preferred embodiment, the dust removing device removes the dust adhering to the second dust separation device, when operation of the electric fan is stopped.

Advantageously, the second dust separation device comprises a pleated filter body.

In a preferred embodiment, the dust removing device removes the dust adhering to the pleated filter body by vibrating the pleated filter body.

DESCRIPTION OF THE PREFERRED EMBODIMENT

Hereinafter, an embodiment of an electric vacuum cleaner according to the present invention will be described with reference to the drawings.

Embodiment

Figure 1:
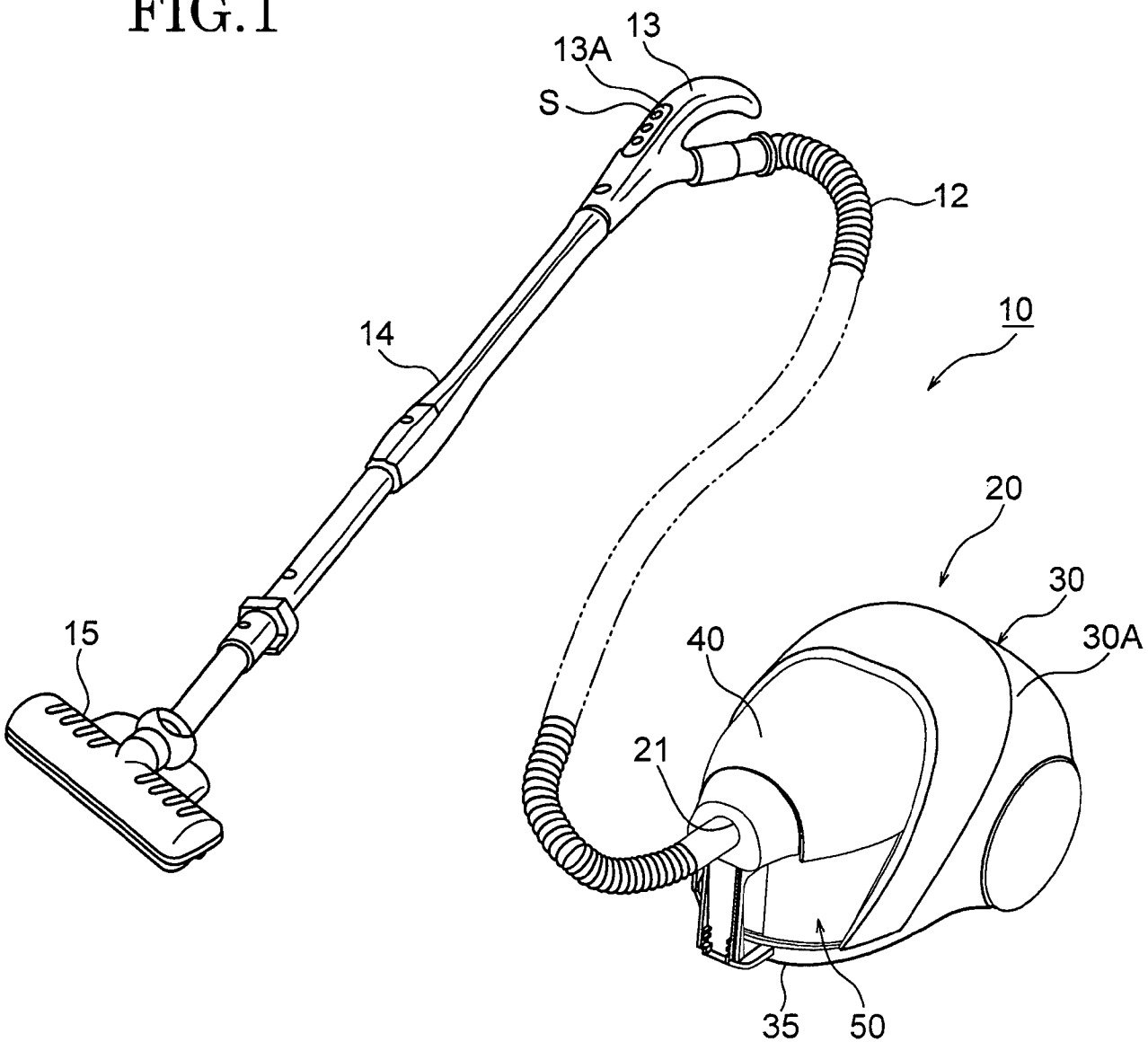
FIG. 1 is a perspective view showing an external appearance of an electric vacuum cleaner according to the present invention.

An electric vacuum cleaner 10 shown in FIG. 1 includes a vacuum cleaner body 20. The front portion of the vacuum cleaner body 20 is provided with a hose connection port 21. A dust collection hose 12 has one end detachably connected to the hose connection port 21 and has the other end provided with a hand operation unit 13. An extension wand 14 is detachably connected to the hand operation unit 13. A suction port 15 is detachably connected to the leading end portion of the extension wand 14. The hand operation unit 13 is provided with an operation part 13A including a plurality of operation switches S.

Figure 2:
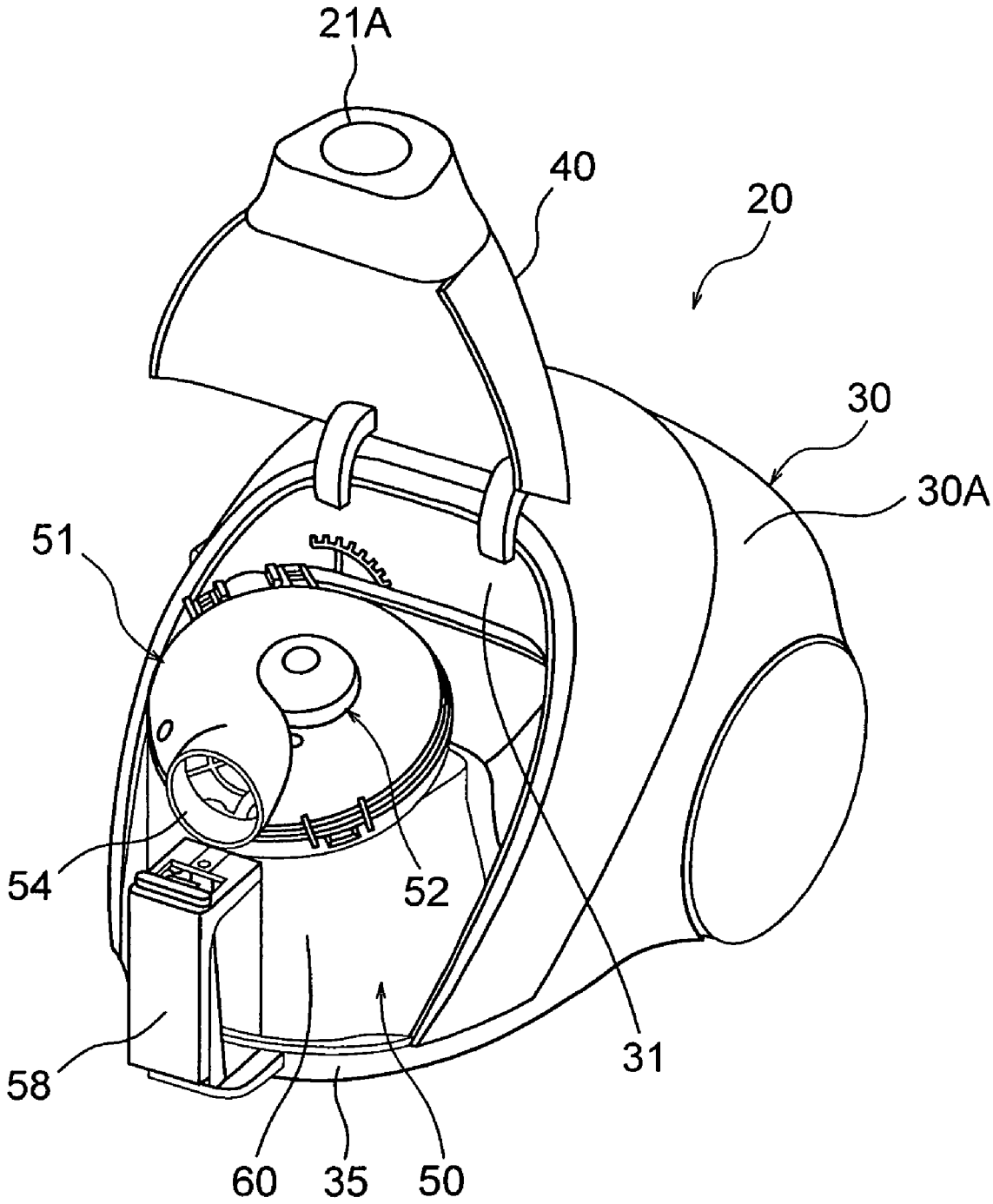
FIG. 2 is a perspective view showing a body of the electric vacuum cleaner.

The vacuum cleaner body 20 includes a body case 30, a dust collection container 50 detachably mounted on the body case 30 and a cover body 40 having the back portion connected to the body case 30 by a hinge so as to be openable and closable in the up and down direction, as illustrated in FIG. 2.

In addition, an electric fan 33 (refer to FIG. 3) is built in a back portion 30A of the body case 30, and a cord reel 34 is disposed below the electric fan 33. A plate-like mounting section 35 is provided in front of the body case 30 (on the left side in FIG. 3). The dust collection container 50 is detachably mounted on the mounting section 35. The cover body 40 and the mounting section 35 enclose the dust collection container 50, so as to fasten the dust collection container 50 when the cover body 40 is closed.

Figure 3:
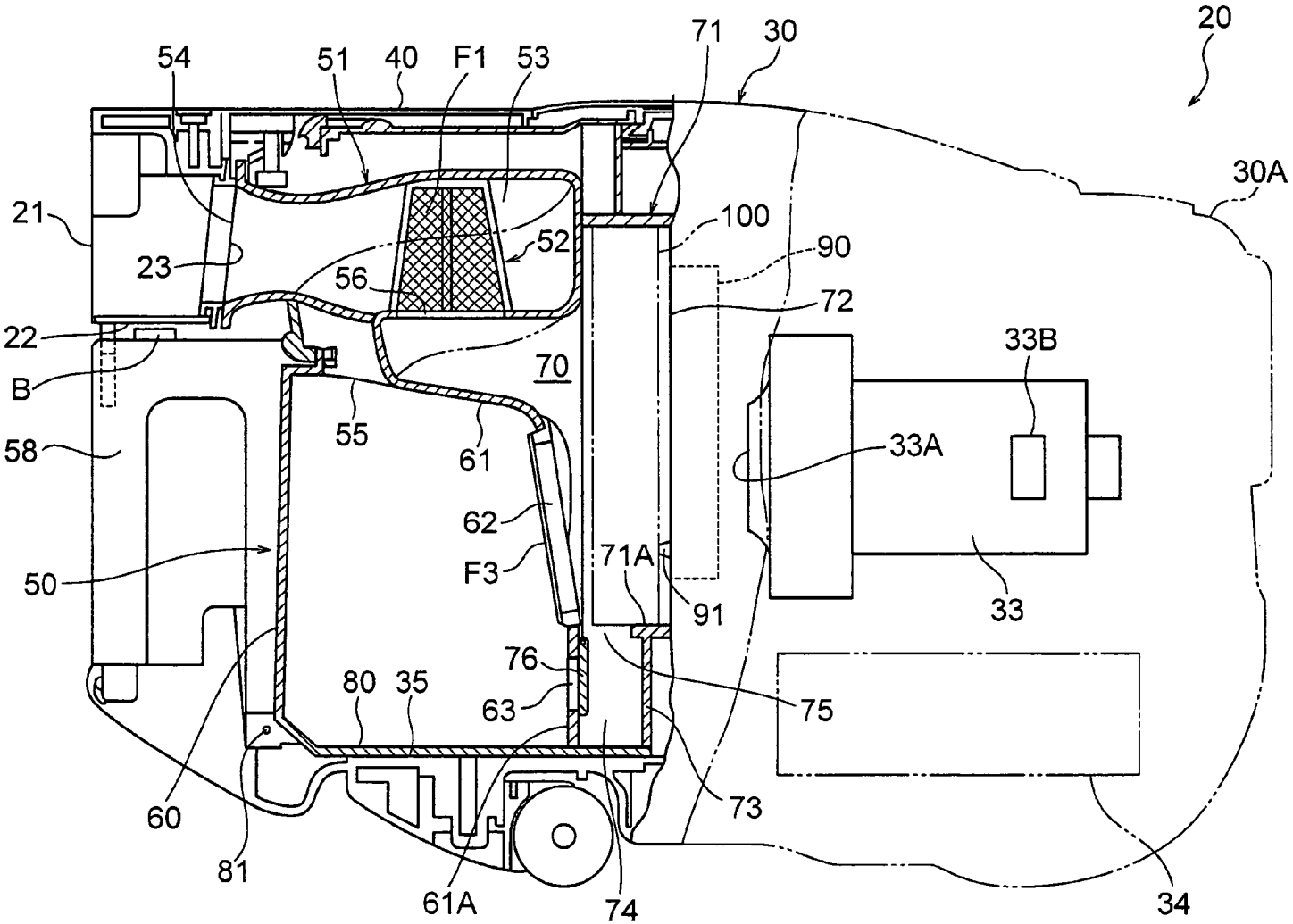
FIG. 3 is a vertical cross-sectional view showing the structure of the electric vacuum cleaner body.

The cover body 40 is provided with a tube portion 22 as shown in FIG. 3. The leading end of the tube portion 22 is the hose connection port 21 and the back end of the tube portion 22 is a connection opening 23.

A front opening (not shown) is formed in a front wall portion 31 (reference to FIG. 2) of the back portion 30A. The front opening communicates with a suction opening 33A of the electric fan 33 via a communication air path (not shown). The communication air path opposed to the front opening is provided with a dust removing device 90.

The dust removing device 90 includes a reciprocating body (not shown) for reciprocating in the width direction of the body case 30 (in the direction orthogonal to the page space of FIG. 3) and a projection 91 provided in the reciprocating body. The projection 91 shallowly engages with a top portion of a pleat of an after-mentioned pleated filter body 100, and the projection 91 moves over the top portions of the pleat by the reciprocating of the reciprocating body. The dust removing device 90 thereby removes the dust adhering to the pleated filter body 100 by vibrating the pleated filter body 100.

The reciprocating body reciprocates for a predetermined time every time the driving of the electric fan 33 is stopped.

Figure 4:
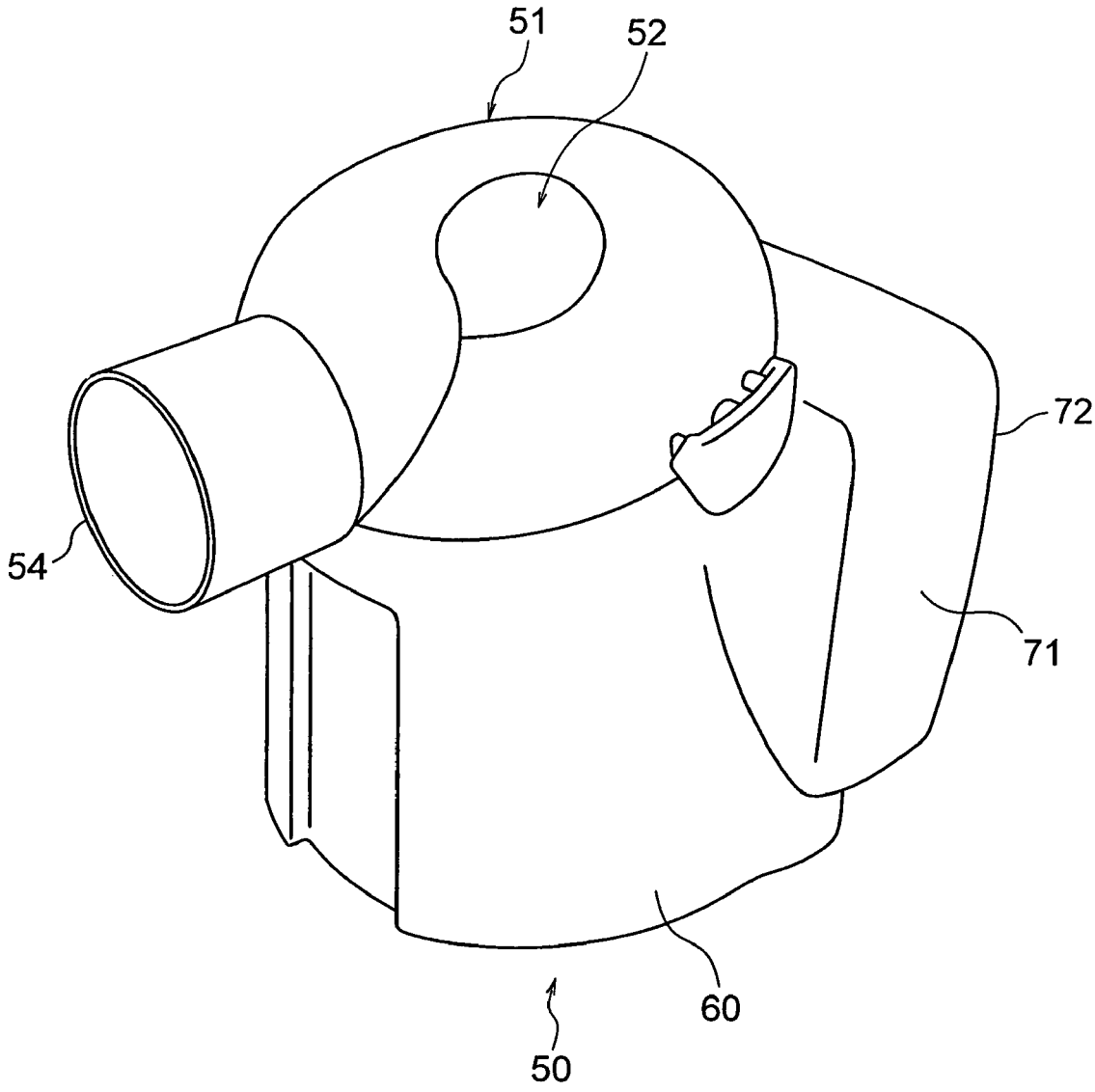
FIG. 4 is a perspective view illustrating a dust collection container.
Figure 5:
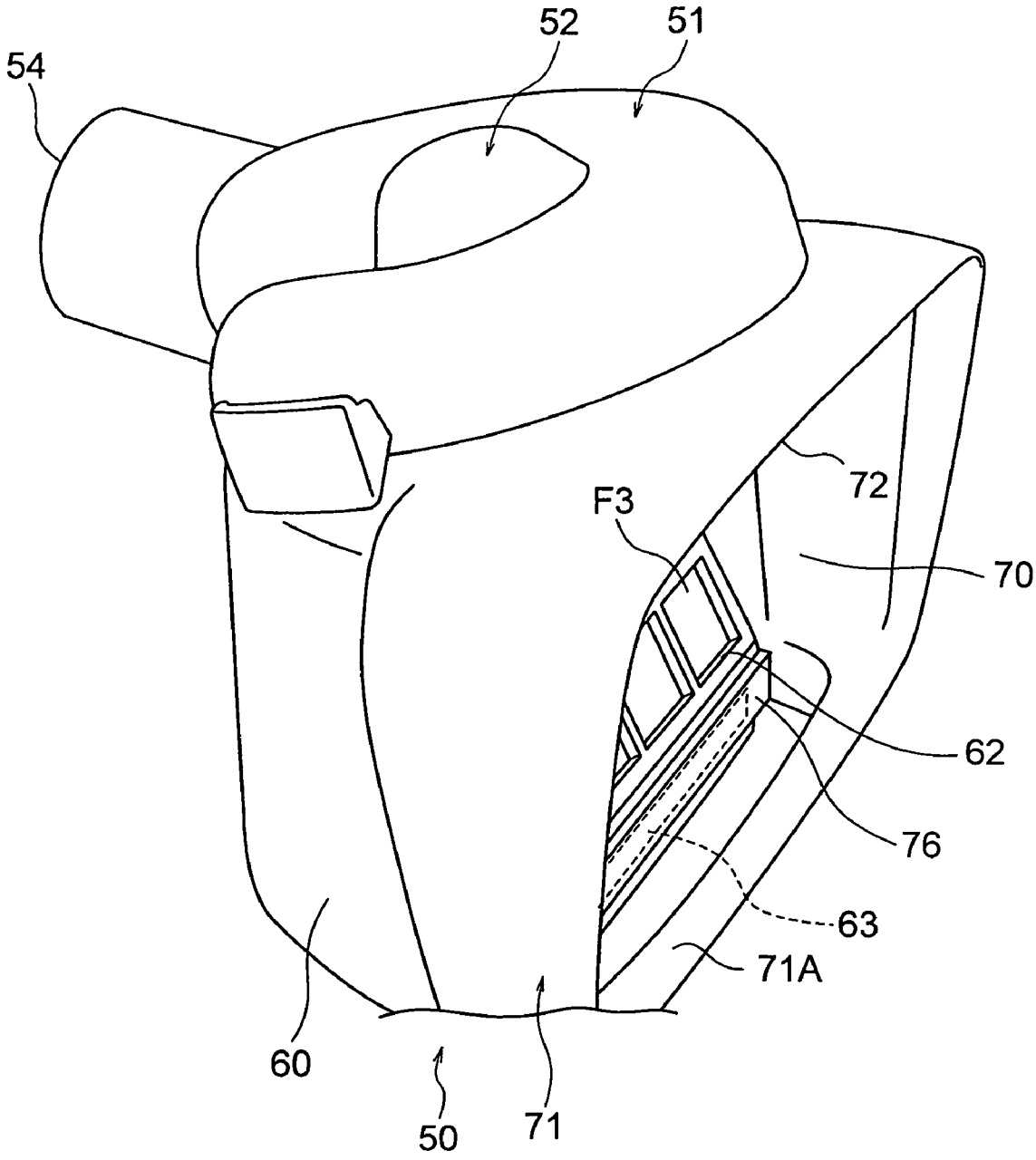
FIG. 5 is a perspective view illustrating the dust collection container shown in FIG. 4 seen from another direction.

As shown in FIGS. 4, 5, the dust collection container 50 includes a round air path section 51 formed on the upper portion thereof, a dust collection section (a first dust collection section) 60 formed below the round air path section 51, a negative pressure room 70 formed at the back of the dust collection section 60, and a bottom pad 80.

Figure 6:
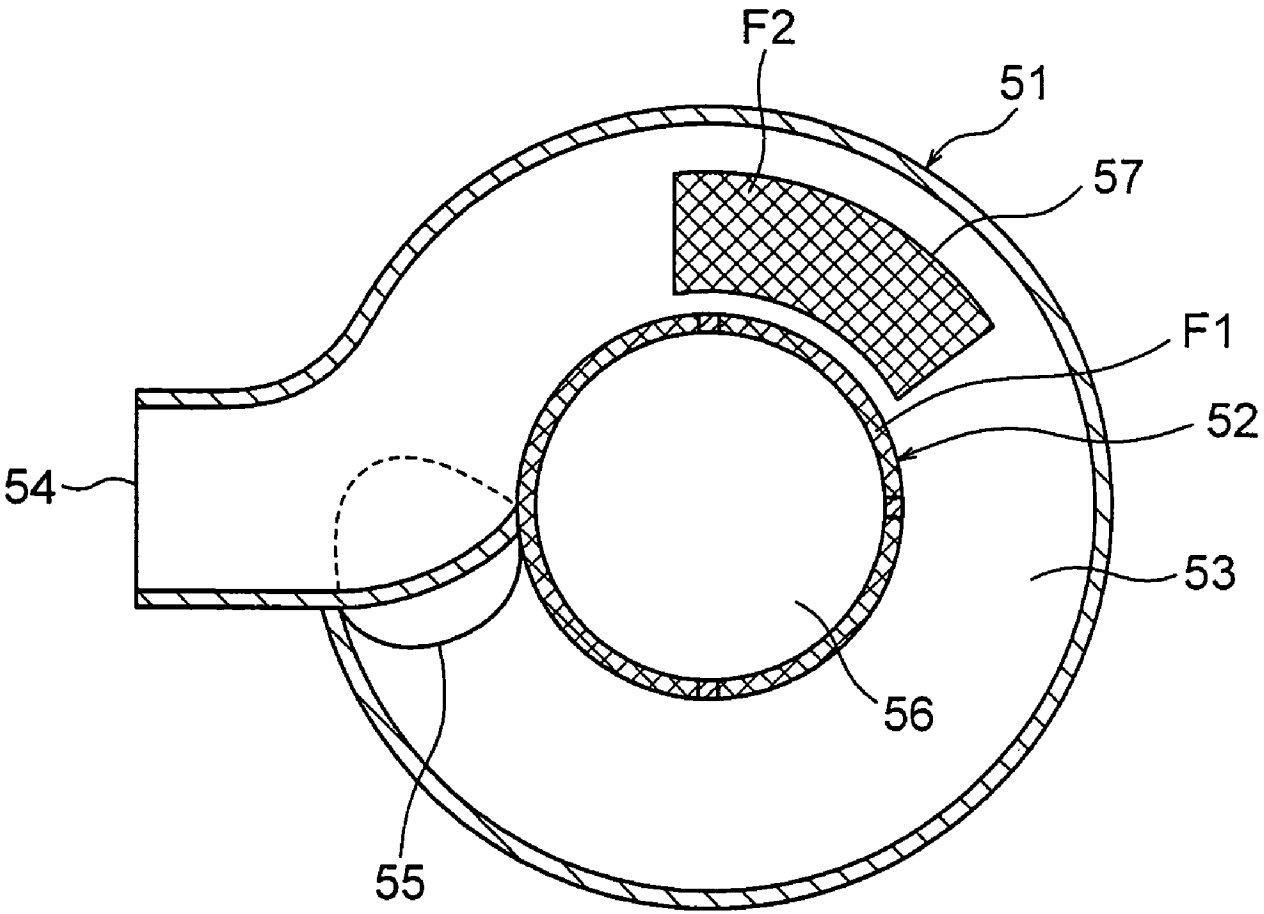
FIG. 6 is an explanatory view showing a structure of a round air path section of the dust collection container.

The round air path portion 51 includes a dust separation section (a first dust separation device) 52 provided in the central portion thereof and a circular arc round air path 53 provided around the dust separation section 52, as shown in FIG. 6. A leading end opening 54 of the leading end of the round air path 53 is connected to the connection opening 23 of the tube portion 22 of the cover body 40 as shown in FIG. 3. The round air path 53 communicates into the dust collection section 60 via a back end opening 55. Moreover, the round air path 53 includes an opening 57 which is formed in the bottom portion in the middle of the round air path 53 and communicates with the negative pressure room 70. A net filter F2 is stretched to the opening 57.

The dust separation section 52 includes a frame (not show) having an almost cylindrical shape and a net filter F1 stretched to the frame. The bottom portion of the dust separation section 52 opens, such that the dust separation section 52 communicates with the negative pressure room 70 via an opening 56.

A dividing wall 61 provided in the back portion of the dust collection section 60 includes an opening 62 which communicates with the negative pressure room 70. A lower portion wall 61A of the dividing wall 61 includes a communication hole (communication opening) 63 positioned in an upper portion of a fine dust collection section 74. More particularly, the communication hole 63 is formed below the opening 62. A net filter (the first dust separation device) F3 is stretched to the opening 62.

A frame 71 for detachably installing a pleated filter body (a second dust separation device) 100 is integrally formed in the back portion of the negative pressure room 70 (on the right side in FIG. 5). A back end opening 72 of the frame 71 is connected to the front opening (not shown) of the body case 30 shown in FIG. 3.

Figure 7:
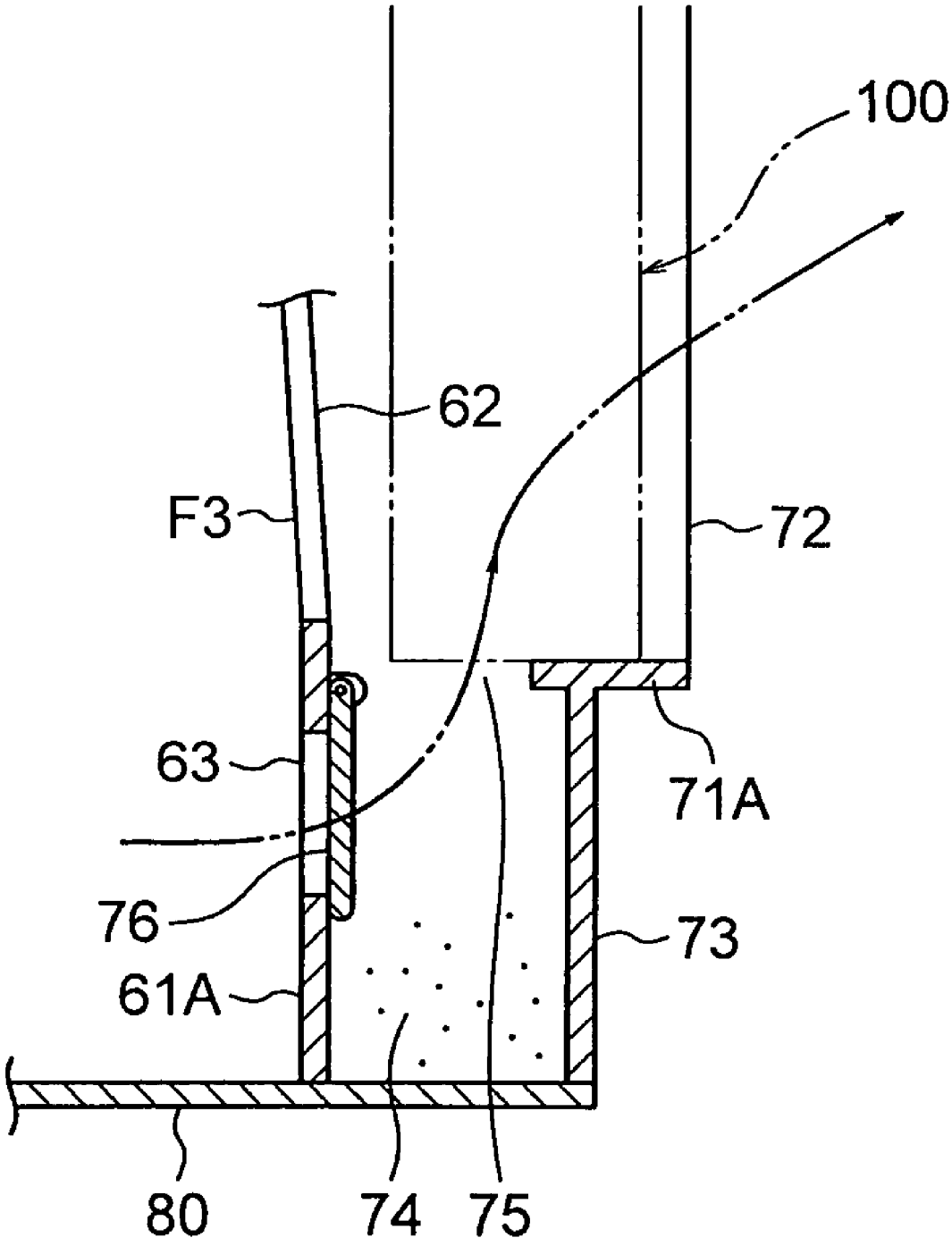
FIG. 7 is an explanatory view illustrating a fine dust collection section.

A lower portion back wall 73 is formed in the lower portion of the frame 71. The fine dust collection section (the second dust collection section) 74 includes a space surrounded by the lower portion back wall 73, the lower portion wall 61A of the dividing wall (partition wall) 61 of the dust collection section 60 and the bottom pad 80. The fine dust collection section 74 communicates with the dust collection section 60 via the communication hole 63 of the dividing wall 61. In addition, as shown in FIG. 7, an introduction opening 75 is formed between a lower frame wall 71A of the frame 71 and the lower portion wall 61A of the dividing wall 61 as shown in FIG. 7.

In addition, one end portion (upper portion in FIG. 7) of an opening and closing plate (opening and closing member) 76 for closing the introduction opening 75 is supported by the lower portion of the dividing wall 61 of the dust collection section 60. The opening and closing plate 76 is rotatable upon one end portion of the opening and closing plate 76. The opening and closing plate 76 closes the communication hole 63 of the dividing wall 61 by its own weight and opens the introduction opening 75 of the fine dust collection section 74, when the electric fan 33 is not driven. The opening plane of the communication hole 63 is configured such that the opening and closing plate 76 rotates to close the introduction opening 75 (refer to FIG. 9), if the pressure in the negative pressure room 70 becomes negative by the driving of the electric fan 33.

The bottom pad 80 is a rotatable in the clockwise direction about an axis 81 illustrated in FIG. 3. If a button B provided in a holding portion 58 of the dust collection container 50 is pressed, the bottom portion of the dust collection section 60 and the bottom portion of the fine dust collection section 74 are opened. Accordingly, the dust accumulated in the dust collection section 60 and the fine dust collection section 74 can be disposed.

[Operation]

Next, the operation of the electric vacuum cleaner having the above structure will be explained.

At first, as shown in FIG. 2, the dust collection container 50 is mounted on the mounting section 35 of the body case 30, and the cover body 40 is closed. As shown in FIG. 1, one end of the dust collection hose 21 is connected to the hose connection port 21 of the cover body 40.

In this state, as illustrated in FIGS. 3, 7, the opening and closing plate 76 of the dust collection container 50 closes the communication hole 63 of the dividing wall 61 by its own weight.

Figure 8:
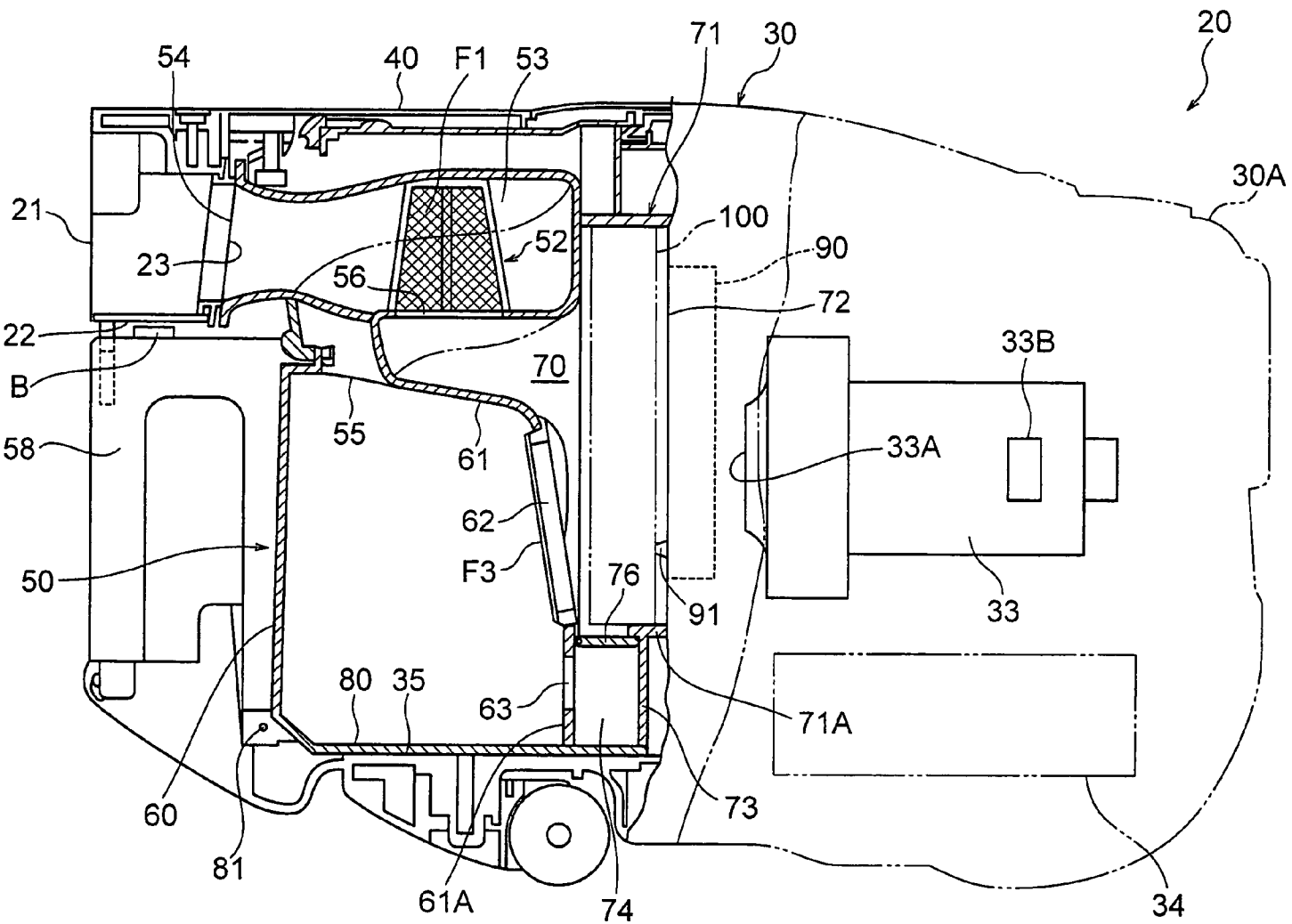
FIG. 8 is a cross-sectional view showing the electric vacuum cleaner body with an introduction opening closed by an opening and closing plate.

If the switch S of the operation part 13A is operated, the electric fan 33 is driven. By the driving of the electric fan 33, air is sucked from the suction opening 33A of the electric fan 33, creating a negative pressure in the negative pressure room 70 of the dust collection container 50. Thereby, the opening and closing plate 76 rotates by this negative pressure so as to close the introduction opening 75 as shown in FIGS. 8, 9.

If the introduction opening 75 is closed by the opening and closing plate 76, the fine dust accumulated in the fine dust collection section 74 is prevented from rising to adhere to the pleated filter body 100.

Figure 9:
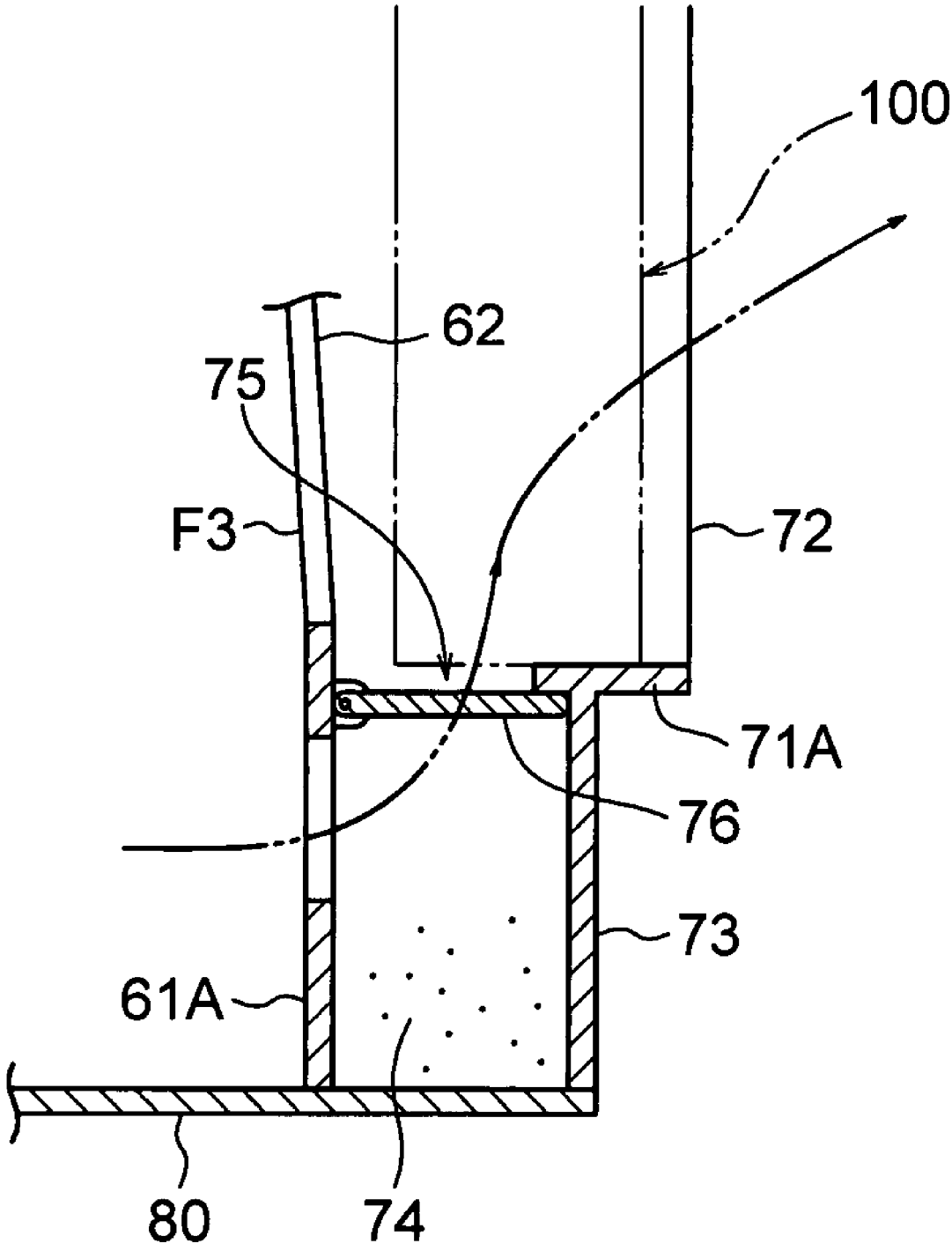
FIG. 9 is an explanatory view showing a fine dust collection section with the introduction opening closed by the opening and closing plate.

In addition, since the communication hole 63 of the dividing wall 61 of the dust collection container 50 is formed in the upper portion of the fine dust collection section 74, the air flows as illustrated by the arrows in FIGS. 7, 9 when the opening and closing plate 76 rotates to close the introduction opening 75. Accordingly, the dust accumulated in the fine dust collection section 74 is not raised by this air.

As described above, the opening and closing plate 76 rotates by the driving of the electric fan 33 so as to close the introduction opening 75; thus, the structure of the opening and closing plate 76 is simplified.

On the other hand, a negative pressure is created in the dust collection section 60 and the round air path 53 by the negative pressure of the negative pressure room 70 of the dust collection container 50. This negative pressure acts on the tube portion 22, the dust collection hose 12, the extension wand 14 and the suction port 15, so as to vacuum the dust together with air from the suction port 15.

The vacuumed dust and air are sucked into the hose connection port 21 of the cover body 40 via the extension wand 14 and the dust collection hose 12. The dust and air sucked into the hose connection port 21 is sucked into the dust collection section 60 through the round air path 53 of the dust collection container 50.

A part of the air is separated from the dust by the round air path 53, and the separated air is sucked to the negative pressure room 70 through the net filters F1, F2.

The dust and air sucked into the dust collection section 60 are separated, and the separated air is sucked to the negative pressure room 70 through the net filter F3 and also the dust is collected in the dust collection section 60.

The air sucked to the negative pressure room 70 is sucked to the suction opening 33A of the electric fan 33 via the pleated filter body 100 or the like. The sucked air is discharged from a discharging port 33B of the electric fan 33, and is discharged outside from a discharging port (not shown) of the body case 30. If the driving of electric fan 33 is stopped, the sucking of dust and air from the suction port 15 is stopped. The degree of vacuum of the negative pressure room 70 of the dust collection container 50 is thereby increased to atmospheric pressure. The opening and closing plate 76 of the dust collection container 50 rotates by its own weight, so as to close the communication hole 63 of the dividing wall 61 as shown in FIGS. 3, 7, opening the introduction opening 75 of the fine dust collection section 74.

On the other hand, the reciprocating body (not shown) of the dust removing device 90 reciprocates for a predetermined time by stopping the driving of the electric fan 33; thus, the dust adhering to the pleated filter body 100 is removed. The dust removed from the pleated filter body 100 is disposed into the fine dust collection section 74 because the introduction opening 75 is opened as shown in FIG. 7.

In order to dispose of the dust accumulated in the dust collection section 60 and the fine dust collection section 74 of the dust collection container 50, the dust collection container 50 is removed from the body case 30, and the bottom pad 80 rotates in the clockwise direction about the axis 81 to open the bottom portion of the dust collection section 60 and the fine dust collection section 74. Accordingly, the dust accumulated in the dust collection section 60 and the fine dust collection section 74 is disposed.

According to one embodiment of the present invention, the introduction opening of the second dust collection section can be opened and closed by means of a simple structure; thus, the re-adhesion of dust can be prevented.

The present application is based on and claims priority from Japanese application No. 2006-99862 filed on Mar. 31, 2006, the disclosure of which is hereby incorporated by reference herein in its entirety.

Although the present invention has been described in terms of an exemplary embodiment, it is not limited thereto. It should be appreciated that variations may be made in the embodiment described by persons skilled in the art without departing from the scope of the present invention as defined by the following claims. In addition, the number, position, shape, or the like of the components are not limited to the above embodiment, and can be changed to the number, position, shape or the like of components preferable for conducting the present invention. Moreover, no element or component in the present disclosure is intended to be dedicated to the public regardless of whether the element or component is explicitly recited in the following claims.

What is claimed is:

1. An electric vacuum cleaner, comprising:

a first dust separation device configured to separate dust sucked by a negative pressure of an electric fan;

a first dust collection section for collecting the dust separated by the first dust separation device;

a second dust separation device configured to separate the dust which has passed through the first dust separation device;

a dust removing device configured to remove the dust adhering to the second dust separation device;

a second dust collection section positioned on an upstream side of the second dust separation device and provided below the second dust separation device, for accumulating the dust removed by the dust removing device;

a partition wall for partitioning the first dust collection section from the second dust collection section; and an introduction opening for introducing the dust removed by the dust removing device into the second dust collection section, wherein the partition wall is provided with a communication opening for communicating the first dust collection section to the second dust collection section, wherein the partition wall is provided with an opening and closing member for closing either of the introduction opening or the communication opening, the opening and closing member being rotatable between closing the introduction opening and closing the communication opening, and wherein the opening and closing member closes the introduction opening due to the negative pressure caused by driving the electric fan and closes the communication opening by its own weight when the electric fan is not driven.

2. The electric vacuum cleaner according to claim 1, wherein the communication opening is formed in an upper portion of the second dust collection section.

3. The electric vacuum cleaner according to claim 1, wherein a bottom portion of the first dust collection section and a bottom portion of the second dust collection section are closed by a same bottom member, which is movable to simultaneously open the bottom portions of the first dust collection section and the second dust collection section.

4. The electric vacuum cleaner according to claim 1, wherein the dust removing device comprises a reciprocating body which is adapted to reciprocate along the second dust separation device, and the reciprocating body includes a projection to engage with the second dust separation device to remove the dust adhering to the second dust separation device.

5. The electric vacuum cleaner according to claim 1, wherein the second dust separation device comprises a pleated filter body.

6. The electric vacuum cleaner according to claim 5, wherein the dust removing device comprises a movable member which engages with a top portion of a pleat of the pleated filter body to remove the dust adhering to the pleated filter body by vibrating the pleated filter body.

* * * * *